United States Patent [19]

Schippers et al.

[11] Patent Number: 4,523,901

[45] Date of Patent: Jun. 18, 1985

[54] CONTROL APPARATUS FOR A POSITIVE DISPLACEMENT RECIPROCATING PUMP

[75] Inventors: Heinz Schippers, Remscheid; Siegfried Hertell, Radevormwald; Otwin Eich, Remscheid, all of Fed. Rep. of Germany

[73] Assignee: Barmag Barmer Maschinenfabrick AG, Remscheid, Fed. Rep. of Germany

[21] Appl. No.: 434,172

[22] Filed: Oct. 13, 1982

[30] Foreign Application Priority Data

Oct. 17, 1981 [DE] Fed. Rep. of Germany ..... 3141359
Nov. 28, 1981 [DE] Fed. Rep. of Germany ..... 3147235
Apr. 1, 1982 [DE] Fed. Rep. of Germany ..... 3212112

[51] Int. Cl.[3] ..... F04B 9/08; F04B 35/02

[52] U.S. Cl. ..... 417/395; 417/390; 91/50

[58] Field of Search ..... 417/390, 394, 395, 383, 417/385; 91/47, 50, 419, 452

[56] References Cited

U.S. PATENT DOCUMENTS

| | | | |
|---|---|---|---|
| 2,741,088 | 4/1956 | Andrews | 91/47 |
| 2,887,093 | 5/1959 | Jones | 91/50 |
| 3,572,979 | 3/1971 | Morton | 417/390 |
| 3,972,654 | 8/1976 | Clayton | 417/395 |
| 4,212,589 | 7/1980 | Bosio | 417/394 |

FOREIGN PATENT DOCUMENTS

| | | |
|---|---|---|
| 1453579 | 11/1961 | Fed. Rep. of Germany . |
| 1118011 | 1/1974 | Fed. Rep. of Germany . |

OTHER PUBLICATIONS

Jordan, Richard C. & Gale B. Priester, Refrigeration and Air Conditioning, New York, Prentice-Hall, Inc., 1948, p. 29.

*Primary Examiner*—Leonard E. Smith
*Assistant Examiner*—Jane E. Obee
*Attorney, Agent, or Firm*—Bell, Seltzer, Park & Gibson

[57] ABSTRACT

A positive displacement reciprocating pump for conveying a liquid or gaseous fluid is disclosed and which comprises a fluid enclosure having a movable piston means mounted therein which sealably divides the enclosure into a pumping chamber on one side and an actuating chamber on the other side. The piston means may comprise either a slideable piston or a flexible diaphragm. An inlet valve and a separate outlet valve are each connected to the pumping chamber, and a control system is provided for intermittently supplying a pressurized working fluid to the actuating chamber so as to intermittently move the piston means in the discharge direction, with the piston means being moved in the opposite or suction direction by either the pressure of the fluid being conveyed, or a suitable spring. The control system for advancing the piston means in the discharge direction includes a source of pressurized working fluid, a working fluid line extending between the source and the actuating member, and a valve operatively connected to the working fluid line for intermittently opening the line to a discharge tank or the like to release the pressure therein.

11 Claims, 11 Drawing Figures

CONTROL APPARATUS FOR A POSITIVE DISPLACEMENT RECIPROCATING PUMP

The present invention relates to a positive displacement reciprocating pump adapted to convey a liquid or gaseous substance, and more particularly, to a novel control apparatus by which the reciprocating operation of the pump is controlled.

Positive displacement reciprocating pumps are characterized by a fluid enclosure having a slideable piston or flexible diaphragm mounted therein, and wherein a reciprocating or pulsating movement is imparted to the piston or diaphragm to change the volume on the pumping side, and thereby provide a pumping effect. While the following detailed description is specific to a reciprocating pump of the diaphragm type, it will be understood that the novel features of the invention are also applicable to a piston type displacement pump.

The pump of the present invention finds particular utility as the circulation pump in an absorption heat pump apparatus. More particularly, the pump of the present invention may be used in an absorption heat pump apparatus to convey the solution from the relatively cool absorber into the heated boiler, the latter being under a higher pressure than the absorber. To hermetically seal the solution from the outside atmosphere, the conveying pump typically comprises a diaphragm type displacement pump, wherein the diaphragm serves to separate the pumping chamber from the actuation chamber. The reciprocating motion of the diaphragm, i.e., the pumping motion of the diaphragm, results from the pulsating pressure of a working fluid which is applied to the actuation chamber of the pump housing. Such diaphragm pumps are known in the prior art, note for example German Auslegeschriften Nos. 1,118,011 and 1,453,579. In the pumps there described, the pulsating pressure of the working fluid is generated by piston pumps, and such that the diaphragm concurrently follows the movement of the piston.

The quantity of the solution being transported in the above described pumps may be controlled by changing the actuating speed of the piston pump. The speed control generally uses a three-phase or AC motor, which however is relatively costly and leads to a decrease in the overall efficiency of the pump. The conveying apparatus disclosed in German Auslegeschrift No. 1,453,579 controls the quantity of the solution being conveyed by the pump by controlling the quantity of the pressurized oil which is delivered on each stroke of the piston pump, which in turn is controlled by a suitable valve arrangement. However, the synchronism between the stroke of the piston pump and that of the diaphragm pump, as is usual with all diaphragm pumps which are actuated by piston pumps, makes it necessary to provide means for compensating for the unavoidable leaks in the pressurized oil system. For this reason, the known apparatus for controlling the quantity of the solution to be conveyed comprises a very complicated valve system, which is not suitable for continuous operation, such as would be required in the operation of an absorption heat pump system.

It is accordingly an object of the present invention to provide an efficient control apparatus for a positive displacement reciprocating pump which is able to efficiently control the quantity of the substance being conveyed, and which also avoids the above noted problems associated with the known pumps of this type.

It is also an object of the present invention to provide an absorption heat pump apparatus having an efficient and reliable circulation pump for the heat carrier solution.

These and other objects and advantages of the present invention are achieved by the provision of a positive displacement reciprocating pump which includes a fluid enclosure, and a movable piston means disposed in the enclosure and sealably dividing the enclosure into a pumping chamber on one side of the piston means and an actuating chamber on the other side thereof. An inlet valve and an outlet valve each communicate with the pumping chamber, and control means is provided for intermittently supplying a pressurized working fluid to the actuating chamber so as to intermittently move the piston means in a direction toward the pumping chamber and thereby discharge the conveyed fluid from the chamber. The inlet to the pumping chamber may have a pressure from the fluid being conveyed which is greater than the pressure of the working fluid, thereby causing the piston means to perform a return stroke, i.e., an intake or suction stroke. However, this return stroke may also be caused by other suitable means, for example, by a spring.

In accordance with the present invention, the actuation chamber of the enclosure receives a substantially constant flow of the working fluid, which is delivered by a constant delivery fluid pump. The working fluid line extending between the constant delivery pump and the actuating chamber is provided with an outlet, which is intermittently opened and closed by a control valve.

The constant delivery pump as used in this description is a pump which is actuated at a constant speed and which provides a constant delivery rate. The predetermined speed need not be controlled nor varied during operation. However, a possibility exists that with some drive motors, their speed may vary slightly at increasing torque (for example, asynchronous motors), but this is not considered significant here. It should also be noted that the power input of the constant delivery pump and its drive motor depends on the pressure of the working fluid, and when the control valve is opened, practically no power is consumed.

It will be understood that the above described pulsating action of the valve is not disclosed in the above referenced German Auslegeschrift No. 1,453,579, since the valve therein disclosed is built as a sleeve, which is connected with a rotatable adjusting knob for axial displacement of the valve. This knob is mounted on a threaded shaft, and therefore can only be slowly adjusted by hand, i.e., not pulsatingly.

The pump of the present invention is particularly well suited as a regulating or metering pump in an absorbtive heat pump system, since the invention can utilize the pressure potential of the solution being conveyed, and secondly, it allows for the control of the control valve apart from the flow of the solution being conveyed, and thus the control fluid has a low mass, and thus a low inertia.

The control valve of the pump of the present invention may be controlled as a function of a measured actual value of a suitable process parameter. For example, when the pump is used in the closed cycle of the heat carrier solution in a heat pump, the valve may be controlled as a function of the heat content of the heat supplying medium. If exhaust gases or atmospheric air are used as the heat supplier, its temperature may be measured and the opening and closing of the control valve controlled as a function of the measured temperature.

In one embodiment of the invention, the pump is so operated that the sum total of the opening time and the subsequent closing time of the control valve forms a working cycle, which remains constant. Within each working cycle, only the duration of the opening time and the closing time is controlled as a function of the process parameter, or the outside temperature of the air, as the case may be. This embodiment permits a relatively simple construction of the electric and electronic control for the control valve.

Another embodiment has been found to be advantageous in that it serves to lengthen the life of the pump. In this case, each working cycle is composed of a constant opening time and a constant closing time, and the number of working cycles per unit of time is controlled as a function of the process parameter or of the outside temperature of the air. The advantage of this embodiment resides in the fact that the diaphragm pump and the valve are actuated, and the constant delivery pump delivers a pressure, only to the extent required by the measured actual value of the process parameter.

The control valve may be actuated by an electromagnet, which also contributes to the low inertia of the pump. In one specific embodiment, the control valve includes a slide having an annular groove, and the slide is actuated by a magnetic plunger in a cylinder. When the slide is in its open position, the annular groove concurrently covers the line from the constant delivery pump to the control valve, the line from the actuation chamber to the control valve, and the drain line from the control valve to the discharge tank. In the closed position, the annular groove covers the line from the constant delivery pump, as well as the line from the control valve to the actuation chamber, and the drain line to the tank is closed.

To avoid exposure of the slide to shock loads, it may be provided with an impact damping cup, the diameter of which is adapted to the magnetic plunger. Since the cylinder is filled with hydraulic fluid, the impact damping cup is also filled with fluid before an impact by the magnetic plunger, and the oil escapes at an impact while providing a damping effect. Similarly, the travel of the slide in its mounting cylinder is defined by a pair of hydraulic impact damping elements. Thus for example, there may be provided an impact dampening cup at each end of the slide in the cylinder, and a corresponding annular lip at each end of the slide. When the magnetic plunger is withdrawn, the slide is returned to its initial open position by a spring, so that the constant delivery pump is again connected to the tank.

A particularly low inertia actuation of the control valve may be achieved by effecting the opening and closing movements of the valve by a hydraulic pre-control valve as hereinafter further described.

Rather than separately actuating the control valve as a function of a process parameter, the invention also contemplates that the control valve may be actuated by the movement of the diaphragm of the pump. In this form of the invention, the pump serves to convey a gas or liquid at a uniform flow rate. In one embodiment, which is distinguished by relatively simple structural components, the slide is held between two springs. One of these springs directly abuts the diaphragm, thereby biasing the slide in accordance with the movement of the diaphragm. In a second embodiment, a connecting rod is used to interconnect the diaphragm and the slide. The slide is mounted coaxially on the rod, and the rod includes collars on each side of the slide, with a spring positioned between each end of the slide and the adjacent collar such that the slide is held on both sides by these springs. In all of these embodiments, the slide of the control valve operates with a non-uniform movement. For example, the slide may be held by a spring which overcomes its dead center position after an initial movement of the slide. A plate spring is particularly suitable for use in this manner. The initial movement of the slide may also be achieved by providing a correspondingly long idle path of travel for the spring. The non-uniform movement of the slide may also be controlled by providing annular grooves and a cooperating ball detent at the opening and closing positions of the slide.

In yet another embodiment, the operation of the control valve is effected by the movement of the diaphragm and includes an interposed hydraulic pre-control system. This pre-control system has the advantage that greater forces may be applied for the operation of the control valve. The pre-control valve alternately connects a pre-control pressure chamber at one side of the slide with the pump or with the discharge tank. To do so, a pre-control collar is mechanically connected with the diaphragm of the pump by means of a connecting rod, while preferably also having an idle or lost motion therebetween. When the maximum intake stroke is reached, the diaphragm moves the rod and collar so that the pre-control chamber of the control valve is opened to the tank so as to release the pressure of the working fluid therein. When the diaphragm has reached its maximum delivery stroke, the rod and collar is moved so that the pre-control chamber of the control valve is connected with the working fluid pump and is thereby subjected to its pressure. The rod and collar of the pre-control system is centered in a neutral position by springs, which are adjustable, and in such neutral position the pre-control collar covers and closes the connection to the pre-control chamber of the control valve.

Some of the objects having been stated, other objects will appear as the description proceeds, when taken in connection with the accompanying drawings in which—

FIG. 1 is a schematic illustration of a reciprocating diaphragm pump and control apparatus, and which embodies the features of the present invention;

FIGS. 2–4 each illustrate a different embodiment of a control valve adapted for use with the present invention;

Figure 10:
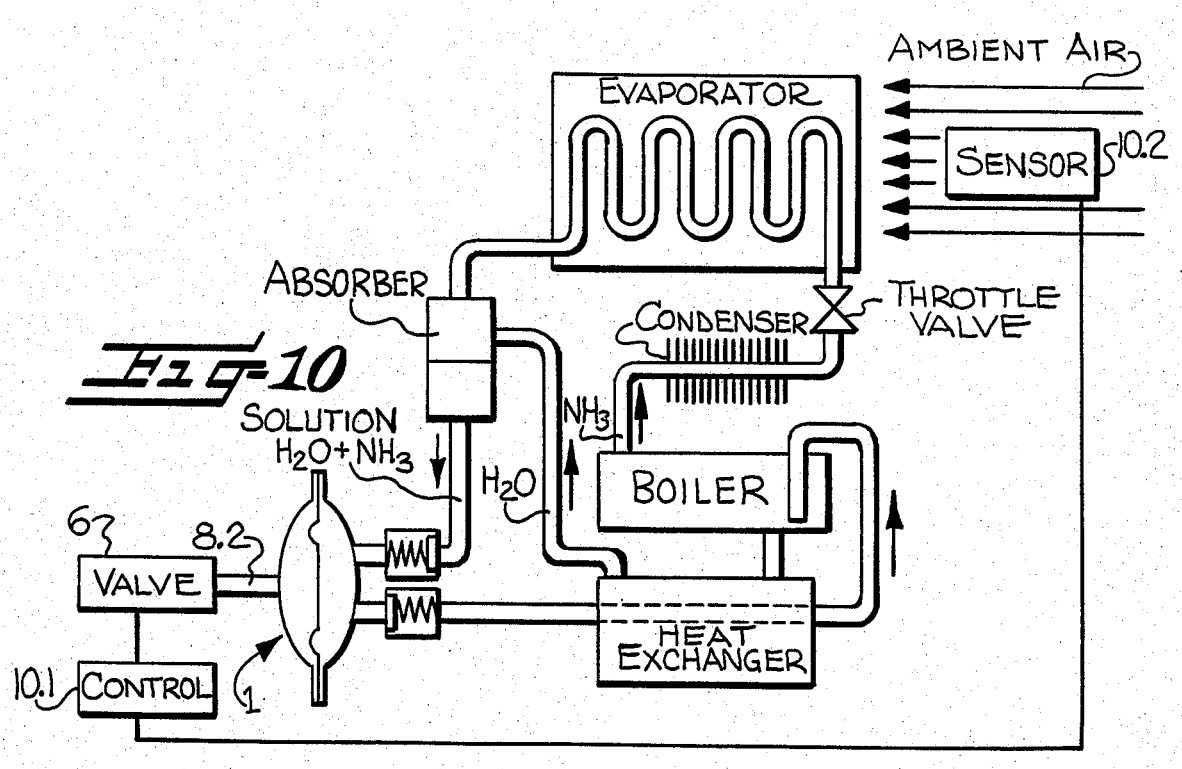
Figure 8:
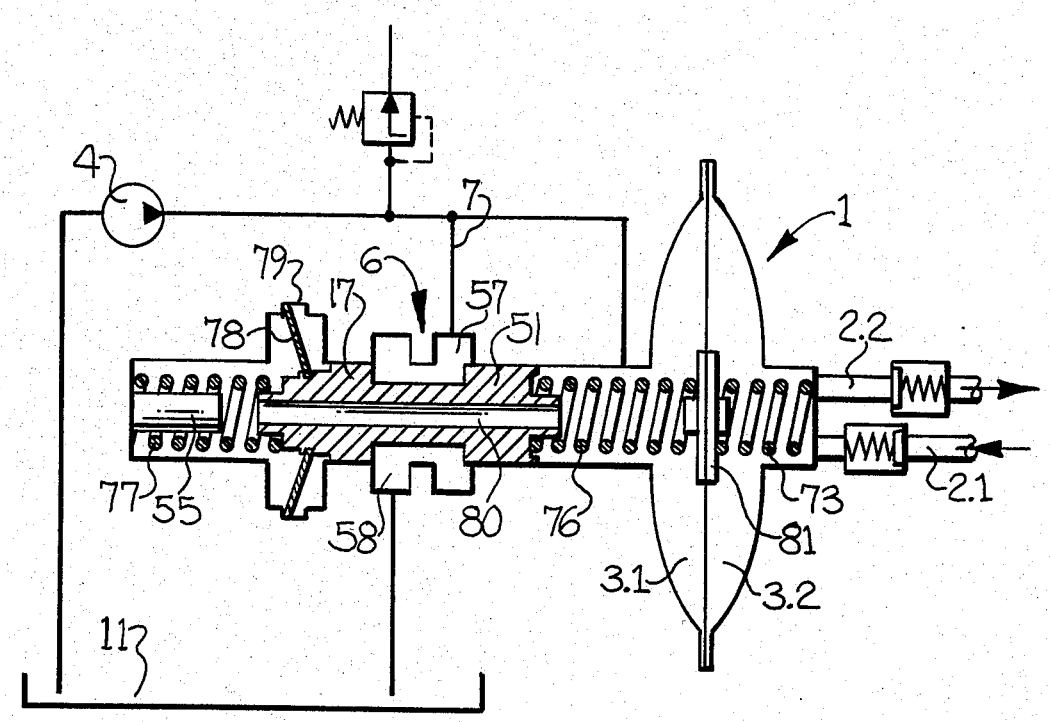
FIGS. 8 and 9 illustrate embodiments of the invention wherein the movement of the control valve is directly controlled by the movement of the diaphragm.
Figure 8A:
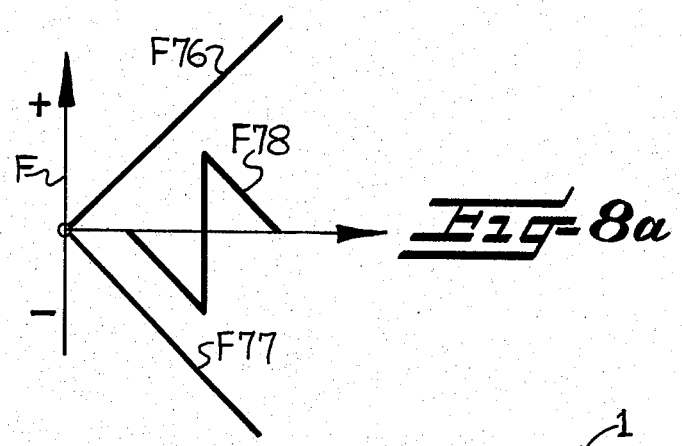

FIG. 8*a* is a force diagram for each of the three springs utilized in the embodiment of FIG. 8; and FIG. 10 is a schematic illustration of an absorption heat pump apparatus which embodies the present invention.

Referring more particularly to the drawing, there is schematically illustrated at 1 a positive displacement reciprocating pump for conveying a liquid or gaseous fluid. In the illustrated embodiment, the pump is in the form of a fluid enclosure 2 having a movable (i.e. flexible) diaphragm 3 disposed in the enclosure and sealably dividing the enclosure into a pumping chamber 3.2 on one side of the diaphragm and an actuating chamber 3.1 on the other side. An inlet valve 2.1 and a separate outlet valve 2.2 each communicate with the pumping chamber 3.2 of the enclosure.

Figure 1:
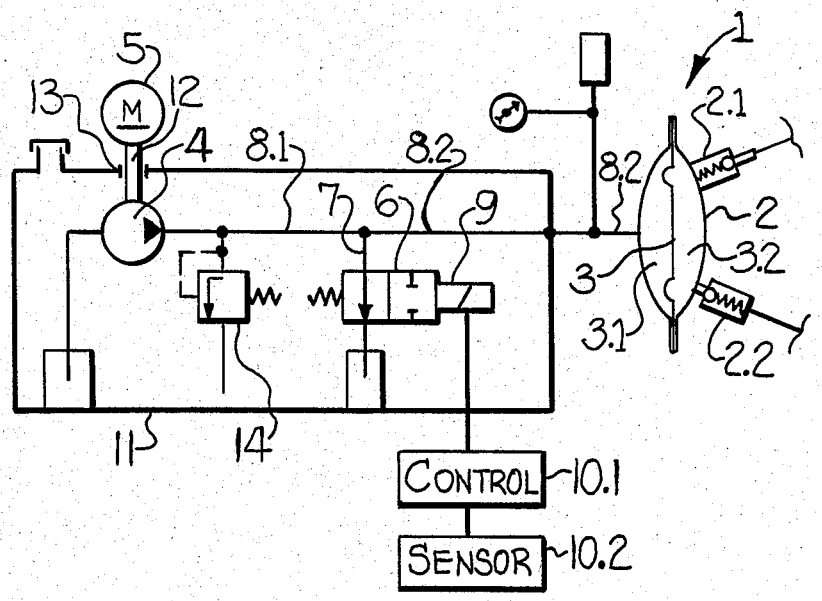

As further described below, the above diaphragm pump 1 may be interposed in a heat carrier system, for example, as a solution pump in an absorptive heat pumping system as illustrated in FIG. 10. In such case, the pressure at the inlet 2.1 normally exceeds atmospheric pressure, and serves to move the diaphragm 3 during the intake or return stroke The pumping action of the diaphragm pump 1 results from the reciprocal motion of the diaphragm 3. More particularly, the actuation chamber 3.1 receives, via lines 8.1 and 8.2, a pressurized working fluid (typically oil) from the constant delivery pump 4, which may be a gear pump or a multicylinder piston pump. The pump 4 is designed to operate at a constant speed, and also deliver a substantially constant flow rate. An electric motor 5 drives the pump 4 at a constant speed. Lines 8.1 and 8.2 have a bypass line 7, which can be opened or closed by the control valve 6. The control valve 6 is actuated by an electromagnet 9, which may be controlled by a control system 10.1, and a measuring device or sensor 10.2 which monitors a process parameter, such as a temperature sensor for monitoring the outside temperature of the air. The opening and closing of the valve 6 alternately releases and applies pressure to the actuation chamber 3.1. When the valve 6 is closed, the conveying pressure of the pump 4 overcomes the pressure in the outlet line 2.2 of the pumping chamber 3.2, to move the diaphragm through its discharge stroke. When the valve 6 is opened (as illustrated in FIG. 1) and thus the pressure released in the lines 8.1 and 8.2, the pressure in inlet line 2.1 pushes the diaphragm in the opposite direction, which corresponds to its intake or suction stroke. The entire control valve may be accommodated in a tank 11 as shown in FIG. 1, which is provided with a seal 13 for the shaft 12 of the motor 5, as well as with outlets for the control line to the electromagnet 9 and the pressure line 8.2. Also, a conventional pressure relief valve 14 may be positioned in the line 8.1.

Figure 2:
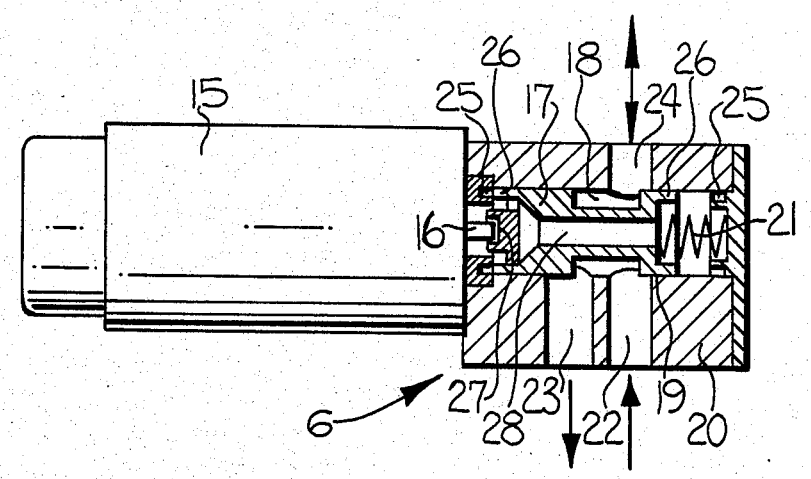

FIG. 2 illustrates an embodiment of the control valve 6 which is adapted for use with the present invention. As there shown, the valve 6 includes a slide 17 which is axially displaced in the cylindrical bore 19 of a valve housing 20. A spring 21 biases the slide to the left, and a plunger 16 of electromagnet 15 is adapted to move the slide to the right. Slide 17 has an annular groove 18, and in the illustrated position, the groove 18 overlies connecting duct 22 which comes from the pump 4, and connecting duct 23 which leads to the tank 11, as well as connecting duct 24 which leads to the actuation chamber 3.1 of the diaphragm pump. Thus when the slide 17 is in the illustrated position, the oil stream delivered by the pump 4, and also the oil stream returned by the diaphragm during its intake stroke, flow off into tank 11. When the magnet 15 is energized, the plunger 16 pushes the slide 17 to the right, until the annular groove 18 overlies only the duct 22 from the pump 4 and the duct 24 to the actuation chamber 3.1. In this position, the actuation chamber 3.1 is subjected to the pressure of the working fluid from the pump 4, and the diaphragm performs its delivery stroke. To avoid shock loads on the slide 17, annular damping cups 25 are arranged at both ends of the bore 19, and the slide 17 includes mating damping lips 26 which move into the cups 25. Since the bore 19 is filled with oil on both front faces of the slide 17, which flows through the central axial bore 28, the lips 26 push the oil slowly out of the cups 25 to soften the impact. To soften the impact of the plunger 16 on the front face of the slide 17, there is provided an impact damping cup 27, which has a diameter substantially adapted to that of the plunger 16. By this arrangement, the impact of the plunger is hydraulically absorbed.

Figure 3:
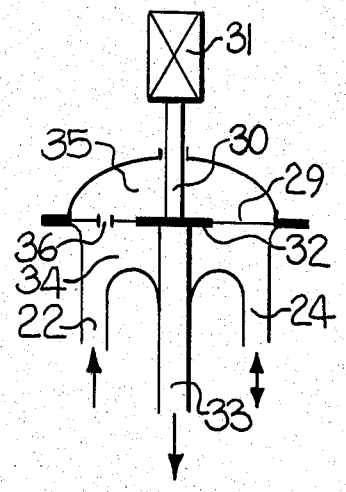

FIG. 3 shows a control valve in the form of a diaphragm valve with a flexible membrane 29 which is reciprocated by plunger 30 and magnet 31. As it does so, the closing lip 32 alternately opens or closes the drain pipe 33, which connects valve chamber 34 with the tank 11. The connection 22 leads from the pump 4, whereas the connection 24 is connected to the actuation chamber 3.1 of the diaphragm pump. An overflow passage 36 connects the pressure relief chamber 35 of the valve with the valve chamber 34.

Figure 4:
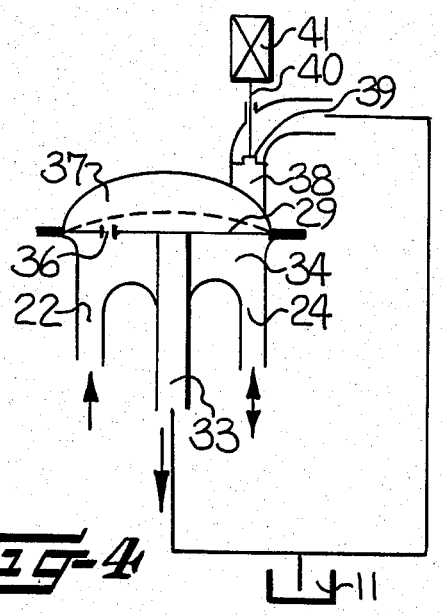

The control valve shown in FIG. 4 is also a diaphragm valve, which is generally the same as the embodiment shown in FIG. 3, and wherein the membrane 29 is acted upon in the control chamber 37, via the overflow passage 36, by the pressure present in the chamber 34. However, the control chamber 37 may also be connected, via the connection 38, valve 39, plunger 40 and electromagnet 41, with the tank 11 so that the pressure in the control chamber 37 will drop when the valve 39 is opened. It should be noted that the cross section of outlet 38 is greater than the cross section of the overflow passage 36. Thus when the pressure decreases in the control chamber 37, the membrane will lift from the closing cross section of the drain line 33, and when the valve 39 closes, the pressure increases again and the diaphragm closes against the drain line 33.

Figure 5:
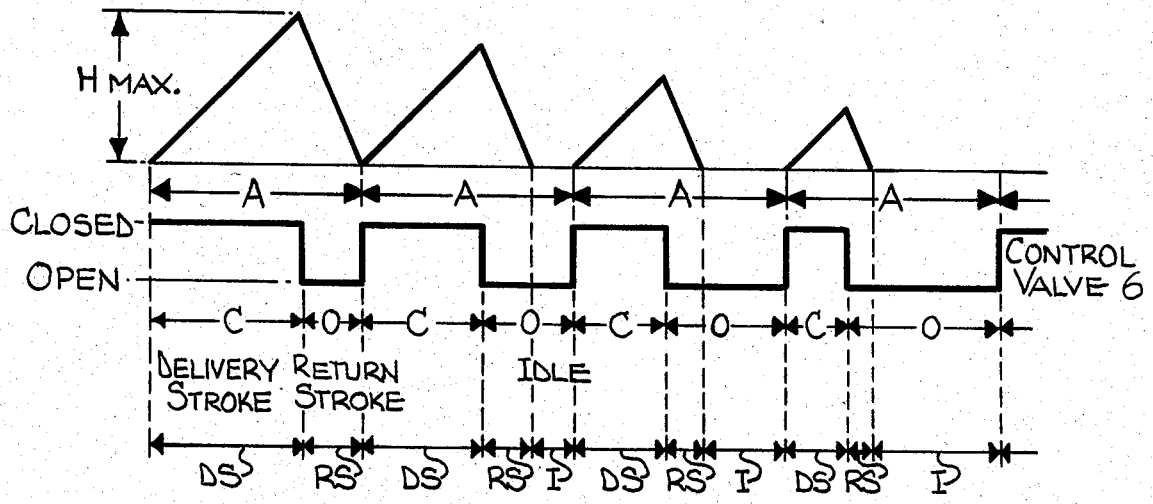
FIGS. 5 and 6 are working diagrams of the control valve and pump of the present invention.

FIG. 5 illustrates a working diagram of the control valve 6 and pump 1. More particularly, FIG. 5 illustrates an embodiment wherein the delivery volume may be decreased from stroke to stroke as a function of a suitable process parameter, such as, for example, the outside temperature of the air.

As illustrated in FIG. 5, the control valve 6 is actuated in a working cycle A which is constant per unit of time. Each working cycle A includes a closing time C and an opening time O, of the valve 6. The pump 1 defines a delivery stroke time DS, and a return stroke time RS, and, if necessary, and idle time I. Since the stroke velocity of the diaphragm pump 1 is primarily determined as a function of pressure, both the delivery and return stroke of the pump 1 may be carried out at a constant velocity. However, the length of each stroke is influenced by the control of the opening and closing time of the control valve 6. When closing time C of the valve 6 takes the entire time which is necessary for the delivery stroke, the diaphragm of the pump 1 performs its maximum delivery stroke H Max. When the closing time is less, a working cycle of the pump 1 includes the delivery stroke DS, the duration of which corresponds to the closing time C, as well as the return stroke time RS and idle time I. The sum of RS and I corresponds to the opening time O of the control valve 6. As can be seen in FIG. 5, the sum of the opening time O and closing time C of the control valve 6 remains constant, and the ratio of the return stroke time RS and the delivery stroke time DS remains constant. The duration of the closing time C and thus the magnitude of the delivery stroke, however, may be varied within each working cycle A, and thus also may be varied the quantity delivered by the pump 1.

Figure 6:
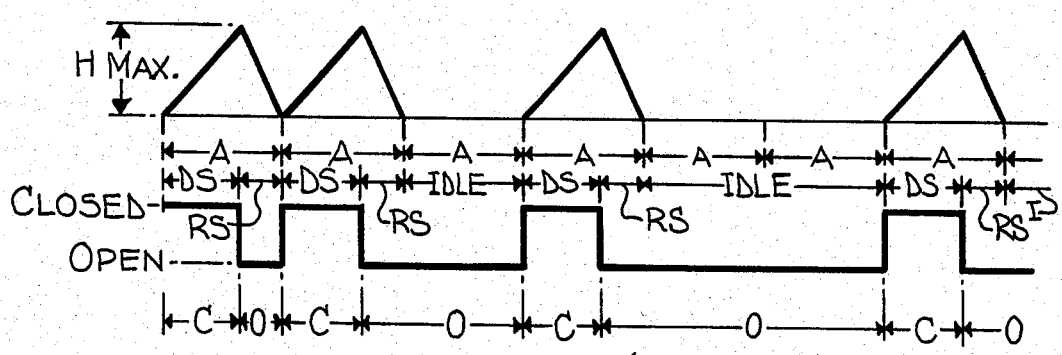

In the control diagram of FIG. 6, the diaphragm pump 1 is actuated only in two operating conditions. In one operating condition, the pump operates at a maximum stroke H Max, and in the other condition the pump is idle. In this mode of operation, the idle time I is preferably an integral multiple of the working time A, which consists of a delivery and a return stroke. The duration of the idle time I is controlled as a function of the process parameter, such as for example, the outside temperature of the air. To perform the delivery stroke, the control valve 6 is closed. While the return stroke is performed, and while the pump is idle, the control valve 6 is opened.

Figure 7:
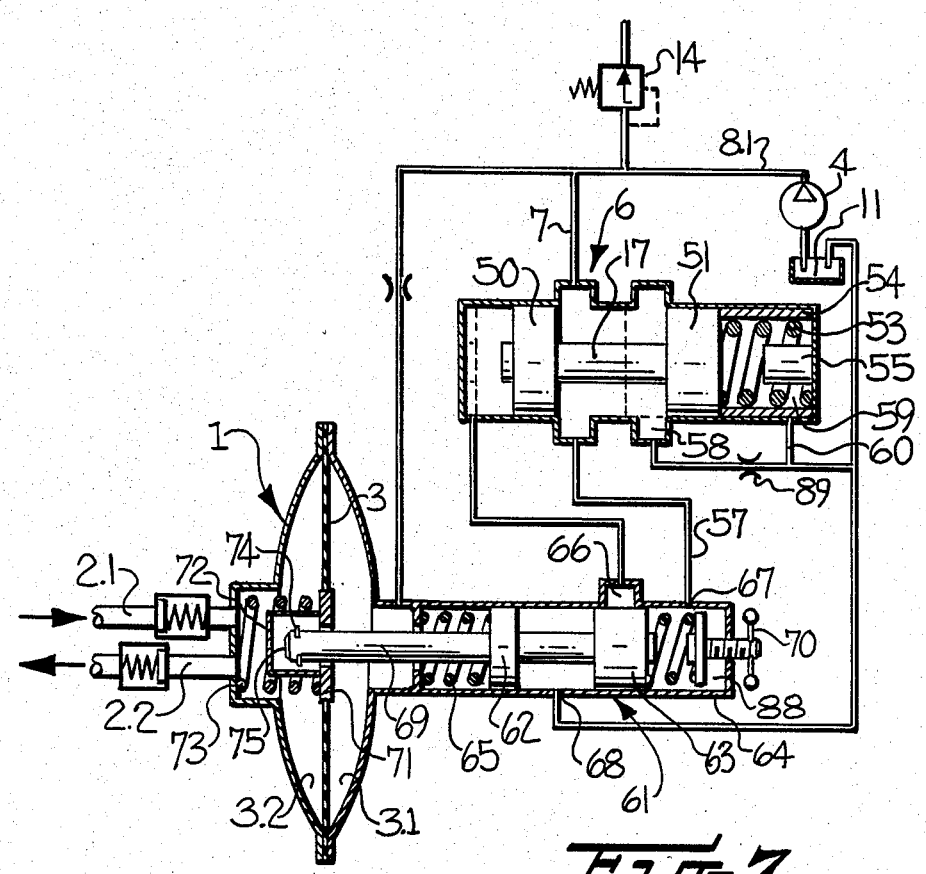
FIG. 7 is a schematic representation of a reciprocating diaphragm pump and control apparatus in accordance with the present invention, and which further includes a hydraulic pre-control system.

FIG. 7 illustrates an embodiment of the invention in which the control valve 6 is controlled by the movement of the diaphragm 3 of the pump 1, with a hydraulic pre-control system being interposed therebetween. Slide 17 of the control valve 6 receives a pre-control pressure on its collar 50 in the pre-control chamber 52, and the slide may thereby be biased against the force of the spring 53. The resulting movement of the slide is limited by the sleeve 54. Spring 53 is operative on the control slide 17 to periodically move the slide to the left and to the dashed line position as shown in FIG. 7, and wherein the bypass line 7 and line 57 to the valve 61 are opened, and the tank outlet 58 of the valve 6 is closed. A pressure in the pre-control chamber 52 is operative to periodically move the valve to the right to the illustrated solid line position, wherein the bypass line 7, the line 57, and the tank outlet 58 are all opened to each other, so that the pressure drops to the tank pressure in the line system 8.1 and 8.2 to the diaphragm pump 1 and in the line 57 to the valve 61.

The pressure in the pre-control chamber 52 is controlled by a collar 63 of the pre-control valve 61. This collar covers outlet 66 and is centered by springs 64 and 65 in the illustrated neutral position. An adjusting screw 70 is provided for adjusting such neutral position. A piston rod 69 mounts a second collar 62 which is axially spaced from the collar 63, and the rod also connects the control collar 63 with the diaphragm 3 of the pump 1. For this purpose, the diaphragm is equipped with an apertured disc 71, as well as with a cap 72 into which the piston rod 69 extends. A ring 74 is attached to the end of the piston rod, which ring is sized to engage the apertured disc 71, since the diameter of the ring 74 is larger than the aperture in the disc 71.

To now describe the operation of the pump 1 as illustrated in FIG. 7, it will be understood that in the illustrated solid line position of the slide 17 of the control valve 6, the pump 4 delivers a pressurized working fluid via line 8.1, bypass line 7, and tank outlet 58, to the tank 11. Inlet 57 is also connected with the tank outlet 58. The pressure of the fluid being conveyed by the pump 1 enters via inlet 2.1 into the pumping chamber 3.2, and the diaphragm 3 moves from its illustrated position to the right.

Pre-control valve 61 with collar 63 closes the outlet 66 in the illustrated position. Thus the working fluid in the pre-control chamber 52 cannot escape. Nor can the spring 53 push the slide 17 to the left. However, when the diaphragm reaches the area of its maximum intake stroke, the cap 72 pushes against the end 75 of the piston rod 69 and moves the control collar 63 to the right. This connects the outlet 66 with the tank connection 68, and the pressure in the pre-control chamber 52 of the valve 6 collapses. As a result, the spring 53 now moves the control slide 17 to the left, until tank outlet 58 is closed. The slide 17 is then in the dashed line position, and as a result, the pressure of pump 4 builds up in line system 8.1 and 8.2 as well as in line 7, and also at the inlet 67 of the pre-control valve 61. The throttle 87 in the line 8.2 delays the pressure buildup in the actuation chamber 3.1.

The pressure supplied by the pump 4 moves the diaphragm toward the left, and the fluid being conveyed by the pump 1 is discharged through the outlet 2.2. In the area of the maximum discharge stroke of the diaphragm, the apertured disc 71 engages the ring 74, and moves the control collar 63 to the left and until outlet 66 is connected with inlet 67. This results in the buildup of the working fluid pressure in chamber 52 of the control valve 6, and the slide 17 is pushed to the right to its original position. This in turn causes the pressure to collapse in the line system 8.1, 8.2 and 7, as well as in actuation chamber 3.1. The diaphragm thereby starts another cycle, and as it does so, after a short movement of the diaphragm, the control collar 63 again covers the outlet 66, so that control slide 17 can no longer move to the left due to the fluid which is contained in the chamber 52. The drop in pressure can be influenced by a throttle 89 in the line 58.

In the embodiment shown in FIG. 8, the slide 17 of control valve 6 includes a central axial bore 80 to relieve any pressure acting on its ends. Thus the slide 17 is movable in the valve housing and is held at its end faces by springs 76 and 77 in a neutral position, in which the bypass line 7 is connected via inlet 57 to the tank outlet 58. Spring 76 abuts the diaphragm of the pump 1 via a supporting plate 81. The movement of the slide 17 to the left as illustrated, is limited by stop 55. Movement is also opposed by an annular spring plate 78, which is mounted in the annular channel 79 of the valve housing. In the indicated position of the control slide 17, no pressure is exerted on the actuation chamber 3.1. As a result, the fluid being conveyed is admitted through inlet 2.1, and the diaphragm moves to the left. This movement increases the force of spring 76, until it is in a position to overcome the sum of spring force 77 and spring force 78. In doing so, the spring plate 78 passes its dead center position, so that it thereafter assists in the movement of the slide to the left and counteracts spring 77. This results in the slide 17 moving in a non-uniform manner to the left, and the slide closes inlet 57. As a result, pressure then builds up in the actuation chamber 3.1 and the diaphragm is displaced to the right, resulting in the force of the spring 76 being reduced. This movement continues until the force of the spring 77 is greater than the sum of the spring force 76 and the spring force 78. At this point, the spring plate 78 again passes its dead center position, and the slide 17 moves in a non-uniform manner to the right, thereby connecting inlet 57 with outlet 58. The pressure in the actuation chamber 3.1 thereby collapses, and the fluid being conveyed again enters into the pumping chamber 3.2 through inlet 2.1.

Figure 9:
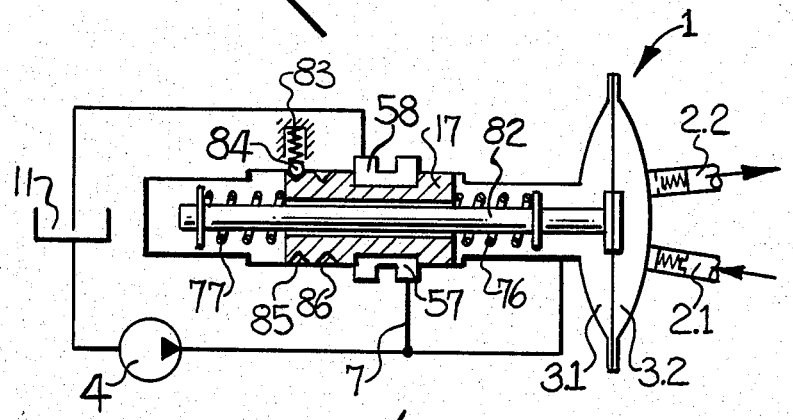

The spring force diagrams as shown in FIG. 8*a* represent the spring forces F for the springs 76, 77, and 78, which are exerted on the control slide 17 during movement of the diaphragm The embodiment shown in FIG. 9 differs from that of FIG. 8 only in that the slide 17 of valve 6 is coaxially and slideably mounted on a connecting rod 82. The rod 82 is in turn fixed to the diaphragm of the pump 1. Also, the rod 82 mounts a pair of springs 76 and 77, between which the control slide 17 is located. A further difference consists in that the operative positions of the slide are determined by annular grooves 85 and 86, which cooperate with a ball detent 84 and spring 83 in the valve housing. In the illustrated position of the slide 17, the ball 84 engages the ring 85, and the working fluid delivered by the pump 4 is guided through bypass line 7 to the tank 11. As a result, the conveyed fluid, being under a higher pressure, moves through inlet 2.1 into the pumping chamber 3.2 and moves the diaphragm and connecting rod 82 to the left. This increases the force of spring 76, until the holding force provided by the spring 83 and ball detent 84 has been overcome. When this occurs, the slide 17 moves to the left relative to the diaphragm, until the groove 86 is engaged by the ball 84. In this position, the pump inlet 57 is separated from the outlet 58, resulting in the pressure building up in the actuation chamber 3.1, so that the diaphragm moves to the right and discharges the conveyed fluid through the outlet 2.2. As it does so, the force of spring 77 increases, until the force is sufficient to abruptly move the slide 17 to the position wherein the groove 85 is again engaged by the ball 84.

If desired, a spring 73 as shown in FIG. 8 can be provided in all of the disclosed embodiments, to compensate for the various forces which are operative on the diaphragm. However, it can also be sufficiently strong so that it operates as a return stroke spring. A return stroke spring is intended to displace the diaphragm so that the conveyed fluid is sucked in through the inlet 2.1. If such a return stroke spring is provided, the pump 1 according to this invention may be used for conveying a substance having a pressure at the inlet 2.1 which is not or not substantially higher than the tank pressure.

FIG. 10 illustrates the pump 1 of the present invention utilized as the circulation pump for the solution in an absorptive heat pump system. In the illustrated example, the heat pump system includes a boiler or generator which is heated by electricity or the like, and which is filled with water containing a high concentration of dissolved ammonia. When this solution is heated, the ammonia is driven off as a vapor and the water remains behind. As the evaporation of the ammonia continues, the pressure rises until it is high enough to cause the ammonia vapor to condense in the condenser. The condensed liquid ammonia passes through the expansion valve and thereupon evaporates again, absorbing heat as it does so. The water which remains behind in the boiler is passed through a heat exchanger, where it loses some of its heat. The water then goes to the absorber, where it again absorbs the ammonia vapor coming from the evaporator. The thus formed ammonia solution is pumped back through the heat exchanger by the circulation pump 1, and the cycle is repeated.

In the drawings and specification, there has been set forth a preferred embodiment of the invention, and although specific terms are employed, they are used in a generic and descriptive sense only and not for purposes of limitation.

That which is claimed is:

1. A positive displacement reciprocating pump for conveying a liquid or gaseous fluid, and comprising a fluid enclosure, movable piston means disposed in said enclosure and sealably dividing the enclosure into a pumping chamber on one side of the piston means and an actuating chamber on the other side thereof, an inlet valve and a separate outlet valve each communicating with said pumping chamber, control means for intermittently supplying a pressurized working fluid to said actuating chamber so as to intermittently move said piston means along a stroke which extends in a direction toward said pumping chamber and thereby discharge the conveyed fluid from such chamber, said control means including a source of pressurized working fluid adapted to deliver a substantially constant flow of working fluid, a working fluid line extending between said source and said actuating chamber for delivering such constant flow to said actuating chamber, and valve means operatively connected to said working fluid line for intermittently opening said line to a discharge tank or the like to release the pressure therein, said control means further including means for actuating said valve means in a sequence of working times and idle times, with each of the working times consisting of a closed time period wherein pressure is maintained in said working fluid line and an open time period wherein said pressure is released in said line, with each of said working times being of essentially uniform duration and with the closed time periods of the working times being of essentially uniform duration which is sufficient to move said piston means along its predetermined stroke, and with the pressure in said line being released during said idle times.

2. The pump as defined in claim 1 wherein said control means further comprises sensor means operatively connected to said valve means for intermittently operating said valve means in response to a sensed operating parameter.

3. The pump as defined in claim 1 wherein said valve means includes electromagnet means for intermittently actuating the same.

4. The pump as defined in claim 1 wherein said valve means includes a valve chamber, an inlet duct in said valve chamber and operatively connected to said source of pressurized working fluid, a connecting duct in said valve chamber and operatively connected to said actuating chamber, a discharge duct in said valve chamber and operatively connected to said discharge tank or the like, and a valve control member movably mounted in said chamber for movement between an open position wherein there is communication between all of said ducts, and a closed position wherein there is communication only between said inlet duct and said connecting duct.

5. The pump as defined in claim 4 wherein said valve control member comprises a flexible diaphragm mounted in said valve chamber, and said valve means further comprises means for selectively moving the diaphragm between said open and closed positions and comprising an electromagnet operatively connected to said diaphragm.

6. The pump as defined in claim 4 wherein said valve control member comprises a slide which is slideably movable between said open and closed positions.

7. The pump as defined in claim 6 wherein said valve means further comprises impact dampening means disposed at each end of said slide, said impact damping means comprising an annular cup and a mating annular lip.

8. The pump as defined in claim 6 wherein said valve means further comprises means for selectively moving said slide between said open and closed positions and comprising a spring operatively positioned at one end of said slide, a plunger operatively disposed at the other end of said slide, and means for selectively advancing the plunger to engage and move the slide against the force of said spring.

9. A positive displacement reciprocating pump for conveying a liquid or gaseous fluid, and comprising a fluid enclosure, a flexible diaphragm sealably disposed in said enclosure and dividing the enclosure into a pumping chamber on one side of the diaphragm and an actuating chamber on the other side thereof, an inlet valve and a separate outlet valve each communicating with said pumping chamber, control means for intermittently supplying a pressurized working fluid to said actuating chamber so as to intermittently move said diaphragm in a direction toward said pumping chamber and thereby discharge the conveyed fluid from such chamber, said control means including a source of pressurized working fluid, a working fluid line extending between said source and said actuating chamber, and valve means operatively connected to said working fluid line and including a slide which is movable between an open position wherein said line is opened to a discharge tank or the like to release the pressure therein, and a closed position wherein the pressure of said working fluid is maintained in said line and delivered to said actuating chamber, said control means further including means for actuating said valve means in a sequence of working times and idle times, with each of the working times consisting of a closed time period wherein pressure is maintained in said working fluid line and an open time period wherein said pressure is released in said line, with each of said working times being of essentially uniform duration and with the closed time periods of the working times being of essentially uniform duration which is sufficient to move said piston means along its predetermined stroke, and with the pressure in said line being released during said idle times.

10. In an absorption heat pump apparatus including a solution containing a solvent such as water and a heat carrier such as ammonia, means for separating the heat carrier from the solvent, means for conveying the separated heat carrier between a condenser and evaporator to sequentially release and absorb heat, means for absorbing the heat carrier into the solvent, and a pump for circulating the solution through the apparatus, the improvement wherein said circulating pump comprises a fluid enclosure movable piston means disposed in said enclosure and sealably dividing the enclosure into a pumping chamber on one side of the piston means and an actuating chamber on the other side thereof, an inlet valve and a separate outlet valve each communicating with said pumping chamber, control means for intermittently supplying a pressurized working fluid to said actuating chamber so as to intermittently move said piston means along a stroke which extends in a direction toward said pumping chamber and thereby discharge the conveyed fluid from such chamber, said control means including a source of pressurized working fluid, a working fluid line extending between said source and said actuating chamber, and valve means operatively connected to said working fluid line for intermittently opening said line to a discharge tank or the like to release the pressure therein, said control means further including means for actuating said valve means in a sequence of working times and idle times, with each of the working times consisting of a closed time period wherein pressure is maintained in said working fluid line and an open time period wherein said pressure is released in said line, with each of said working times being of essentially uniform duration and with the closed time periods of the working times being of essentially uniform duration which is sufficient to move said piston means along its predetermined stroke, and with the pressure in said line being released during said idle times.

11. In the absorptive heat pump apparatus as defined in claim 10 wherein said piston means comprises a flexible diaphragm.

* * * * *